US009132672B2

(12) United States Patent
Warner et al.

(10) Patent No.: US 9,132,672 B2
(45) Date of Patent: Sep. 15, 2015

(54) CONTROLLING EXIT VELOCITY OF PRINTED SHEETS BEING STACKED TO OPTIMIZE STACK QUALITY

(75) Inventors: Victoria L. Warner, Caledonia, NY (US); David L. Rasmussen, Fairport, NY (US); Michele D. Cleary, Rochester, NY (US); Aldwin A. Roberts, Rochester, NY (US); Benjamin W. Paulson, Webster, NY (US); Biruk Gossaye, Rochester, NY (US); Jamison Delorenzo, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 823 days.

(21) Appl. No.: 13/291,132

(22) Filed: Nov. 8, 2011

(65) Prior Publication Data

US 2013/0114985 A1 May 9, 2013

(51) Int. Cl.

*B41J 11/00* (2006.01)
*B41J 11/42* (2006.01)
*B41J 13/10* (2006.01)

(52) U.S. Cl.

CPC ..... *B41J 11/42* (2013.01); *B41J 13/106* (2013.01)

(58) Field of Classification Search

CPC ..... B41J 11/51
USPC ..... 400/582
See application file for complete search history.

(56) References Cited

U.S. PATENT DOCUMENTS

| | | | | |
|---|---|---|---|---|
| 5,043,711 | A * | 8/1991 | Harrington | 345/440 |
| 5,519,478 | A * | 5/1996 | Malachowski | 399/68 |
| 5,794,929 | A | 8/1998 | Curley et al. | |
| 5,831,744 | A * | 11/1998 | Kataoka | 358/296 |
| 6,032,004 | A | 2/2000 | Mirabella, Jr. et al. | |
| 6,370,354 | B1 * | 4/2002 | Chapman et al. | 399/394 |
| 6,435,641 | B1 * | 8/2002 | Tung et al. | 347/16 |
| 6,676,124 | B1 | 1/2004 | Wirtz | |
| 6,761,351 | B1 * | 7/2004 | Howe | 271/3.15 |
| 7,686,302 | B2 * | 3/2010 | Tanahashi et al. | 271/265.01 |
| 7,871,073 | B2 * | 1/2011 | Noguchi et al. | 271/265.01 |
| 8,205,881 | B2 * | 6/2012 | Terada | 271/265.01 |
| 8,226,080 | B2 * | 7/2012 | Morita et al. | 270/58.13 |
| 2002/0062749 | A1 * | 5/2002 | Kelley et al. | 101/232 |
| 2004/0164480 | A1 | 8/2004 | Mayerberg, II et al. | |
| 2005/0095050 | A1 * | 5/2005 | Saito et al. | 400/611 |
| 2007/0090584 | A1 | 4/2007 | Brown et al. | |
| 2008/0165216 | A1 * | 7/2008 | Lee | 347/16 |
| 2010/0110470 | A1 * | 5/2010 | Teshima | 358/1.14 |
| 2011/0181649 | A1 * | 7/2011 | Samoto | 347/16 |

* cited by examiner

*Primary Examiner* — Anthony Nguyen
(74) *Attorney, Agent, or Firm* — Gibb & Riley, LLC

(57) ABSTRACT

Methods and devices determine the media properties of a sheet of media exiting a printing device. The methods and devices apply the media properties to a predetermined velocity equation to calculate a corresponding sheet exit velocity for the sheet of media that will optimize stack quality in a particular output tray. Then, the methods and devices change process controls sheet movement elements within a media path of the printing device to cause the sheet of media to exit the printing device at the sheet exit velocity.

20 Claims, 4 Drawing Sheets

CONTROLLING EXIT VELOCITY OF PRINTED SHEETS BEING STACKED TO OPTIMIZE STACK QUALITY

BACKGROUND

Embodiments herein generally relate to printing and stacking devices and more particularly to devices and methods that apply the process length, the cross-process length, and the weight of a sheet exiting a printing device to a predetermined velocity equation to calculate a corresponding sheet exit velocity that will optimize stack quality.

In modern high-speed printing devices, some printed sheet exit velocities can result in poor stack quality in the output tray. At faster speeds, problems such as poor stack alignment, damaged sheets, sheets out of order, and sheet roll-over produce unacceptable stack quality in the output tray.

SUMMARY

An exemplary method herein maintains a predetermined velocity equation within a non-volatile storage medium of a printing device (the non-volatile storage medium is readable by a processor of the printing device). The predetermined velocity equation outputs different sheet exit velocities for different process lengths, different cross-process lengths (sometimes referred to herein as "widths") and different weights of different sheets of media. This exemplary method also determines the process length, the cross-process width, and the weight (and/or other media properties) of a sheet of media exiting the printing device (using at least one sensor or at least one input of the printing device).

If the process length, the cross-process width, or the weight of the sheet of media (that is currently in the process of exiting the printing device) is different from the immediately previous sheet (or if the immediately previous sheet does not exist because this is the first sheet being processed) the various embodiments herein perform a "sheet output operation change process".

The sheet output operation change process can be performed, for example, after the process length and cross-process width are determined or sensed by sensors, but before the sheet of media actually exits the printing device. The sheet output operation change process applies the media properties to the predetermined velocity equation to calculate a corresponding sheet exit velocity for the sheet of media (using the processor). Then, the sheet output operation change process controls sheet movement elements within a media path of the printing device (using the processor) to cause the sheet of media to exit the printing device at the sheet exit velocity.

The sheet movement elements within the media path can comprise one or more roller nips, and the sensor can comprise one or more edge sensors positioned, for example, within one sheet length of the roller nip.

Further, the embodiments herein can also establish the predetermined velocity equation using a number of different methods. For example, the methods herein can empirically test sheets (through actual tests or modeling/simulation) having different process lengths, different cross-process widths, and different weights at different sheet exit velocities to establish acceptable sheet exit velocities that cause the sheets to conform to a predetermined stack quality factor. The predetermined stack quality factor generally requires the output sheets to stack neatly in the output order without rotating, folding, rolling, flipping, etc. Thus, the methods herein can establish the predetermined velocity equation by correlating different combinations of different process lengths, different cross-process widths, and different weights to a corresponding acceptable sheet exit velocity that conforms to the predetermined stack quality factor. In order to allow the maximum number of sheets to be output during any given time period, the corresponding acceptable sheet exit velocity can be the highest sheet exit velocity that still conforms to the predetermined stack quality factor for a given combination of process length, cross-process width, and weight. Even though exit velocity is changed based on sheet parameters, the methods and systems herein do not impact overall output productivity. The methods and systems herein speed up or slow down exit velocity to optimize within an allowable range of velocities that still maintain rated PPM (prints per minute). Therefore, any velocity within this allowable range will not impact productivity. This is achieved by taking advantage of the gap that exists between sheets. For example, if sheets are slowed to a lower exit velocity, the gap between sheets at the purge tray exit shrinks; however, the required PPM is still consistently maintained.

Various printing device embodiments herein can include, for example, a processor and a non-volatile storage medium operatively connected to the processor. Again, the non-volatile storage medium is readable by the processor. With the embodiments herein, the non-volatile storage medium maintains the predetermined velocity equation that outputs different sheet exit velocities for different process lengths, different cross-process widths, and different weight of different sheets of media (discussed above).

Further, the printing device embodiments herein can also include one or more sensors operatively connected to the processor. The sensors can potentially sense the process length, cross-process width, and weight of the sheet of media exiting the printing device. The sensors can comprise, for example, one or more leading edge sensors, trailing edge sensors, side edge sensors, sheet thickness sensors, scale (weight) sensors, etc. Further, these sensors can be positioned at any location within the printing device and, in one example, can be positioned immediately adjacent the exit roller nip that controls the printer exit velocity of the sheet of media. For purposes herein, immediately adjacent can mean, for example, within one sheet length (in the process length direction) of exit roller nip.

The user can also input the length, width, and weight of the media through at least one user interface (that is operatively connected to the processor) when the user is loading reams of unprinted media into the printer. Further, the length, width, and weight of the media can be automatically determined using sensors of the printing device by scanning barcodes printed on the outside of the reams of unprinted media (or such information can be sensed through wireless detection (RFID communications, etc.) sensors of the printing device) as the reams of paper are loaded into the printing device. Additionally, the embodiments herein can use any combination of sensors to verify the correctness of the information input by the user regarding the length, width, and weight of the printing media.

Further, a media path is also operatively connected to the processor. The media path has sheet movement elements that move the sheets of media from the input to the exit of the printing device. For example, the sheet movement elements within the media path comprising roller nips (formed between opposing nips, at least one of which is driven), belts, vacuum devices, paper guides, etc.

The processor applies the media properties to the predetermined velocity equation to calculate a corresponding sheet exit velocity for the sheet of media. Further, the processor controls the sheet movement elements within the media path of the printing device to cause the sheet of media to exit the printing device at the sheet exit velocity.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

As mentioned above, printed sheet exit velocities can result in poor stack quality in the output tray. Therefore, the embodiments herein utilize a calculation to adjust (slow down or speed up) the velocity of the stacker top tray motor based on sheet data. Sheet properties used for this include, but are not limited to, process length (sometimes referred to herein as "sheet length"), cross-process length (sometimes referred to herein as "cross-process width" or "sheet width"), and sheet weight.

An independently controlled exit nip provides the drive force to move sheets into the output tray. The exit nip is driven by a variable speed motor to slow sheets down as they enter the purge tray. Slowing sheets down before releasing them into the tray can sometimes improve stack quality. However, media properties such as weight (in, for example, grams per square meter (GSM)), process length (PL), and cross-process length (CPL) impact the optimal exit velocity into the tray. The length measures can be in any acceptable units, and are described here in millimeters. The methods and devices herein perform a real-time calculation to determine a purge tray exit nip velocity based on media properties. This optimizes stack quality performance in the output tray for a wide range of media weights, coatings, and sizes.

Figure 5:
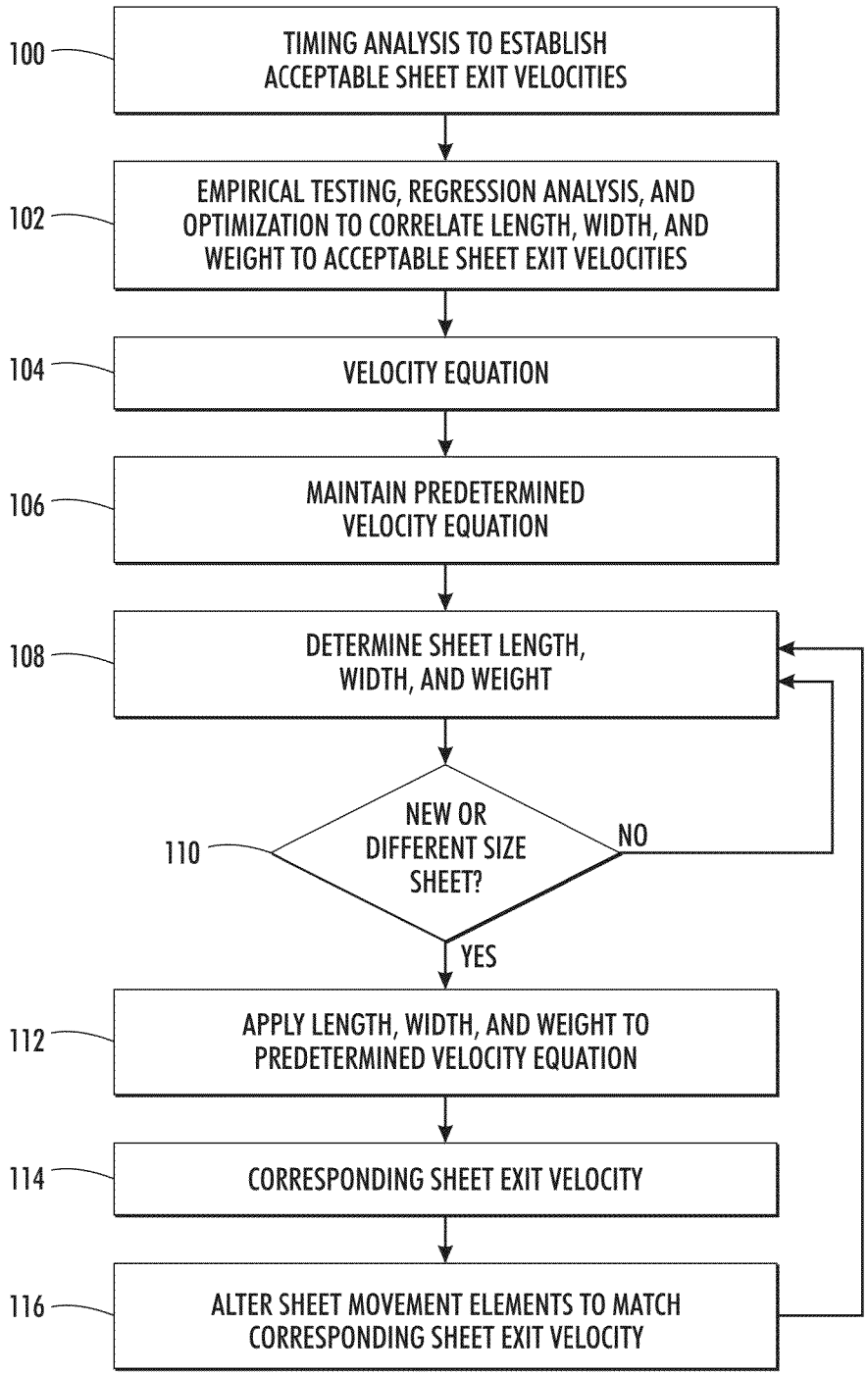
FIG. 5 is a flow diagram illustrating various methods according to embodiments herein.
Figure 6:
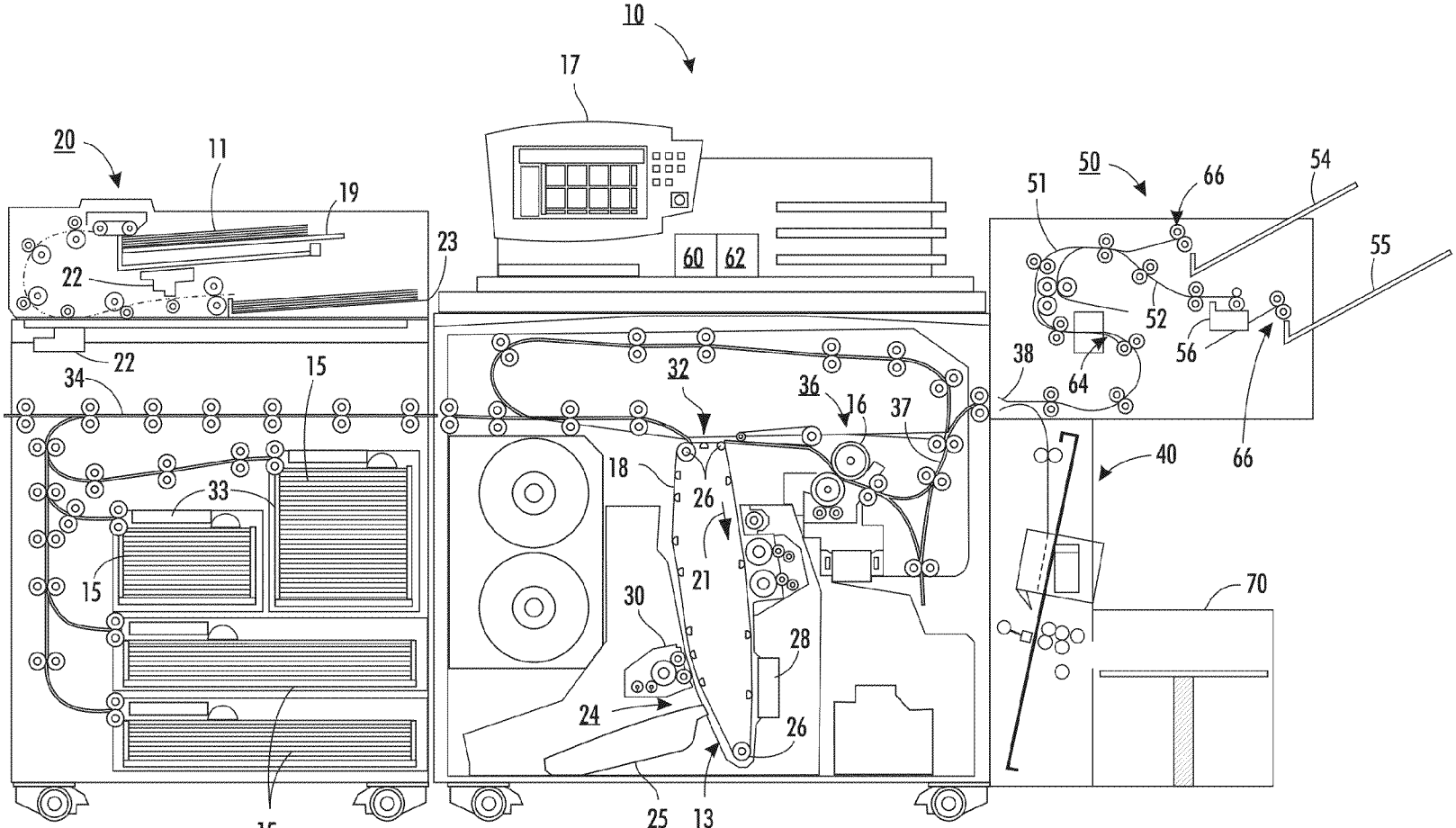
FIG. 6 is a side-view schematic diagram of a device according to embodiments herein.

FIG. 5 is flowchart illustrating an exemplary method herein. This exemplary method begins by establishing a predetermined velocity equation, using any of a number of different methods. For example, in item 102 this method herein can empirically test sheets (or simulate the sheet testing) having different process lengths, different cross-process widths, and different weights at different sheet exit velocities to establish acceptable sheet exit velocities that cause the sheets to conform to a predetermined stack quality factor. The predetermined stack quality factor generally requires the output sheets to stack neatly in the output order without rotating, folding, rolling, flipping, etc.

Figure 1:
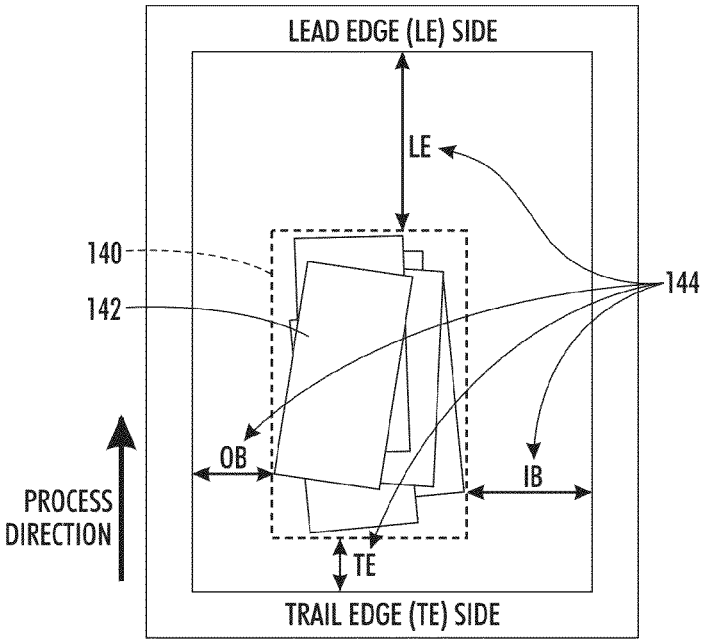
FIG. 1 is a top-view schematic diagram according to embodiments herein.

FIG. 1 is a top-view schematic diagram that provides an example of such empirical testing that is used to measure the quality of the stack using a technique referred to herein as the stack quality factor (SQF) measurement technique. In FIG. 1, the process direction is represented by an arrow, item 140 is a rectangle that indicates the actual stack footprint of a stack of sheets, and items 142 represent sheets in the sample paper stack. Item 144 illustrates four furthest distance measurements taken (outboard measure (OB), inboard measure (IB), trailing edge measure (TE), leasing edge measure (LE)) for each stack from the furthest corner of the paper to the center of the stacker tray. For each measurement, the (SQF) measurement technique selects the paper corner that would create the worst-case footprint, as shown by the rectangle 140.

One exemplary SQF calculation measures and records all 4 sides of stack (OB, IB, LE, TE) 144. Next, this SQF calculation calculates actual stack footprint. For example the tray length may be 580 mm, the tray width may be 430 mm, Footprint=(580−LE−TE)*(430−IB−OB)

Calculate SQF: SQF=[(Stack Footprint/Sheet Area)−1]*1000

Note: Perfect stack SQF=0

The calculation can be, for example, obtained empirically using a series of tests order obtained through modeling to optimize purge tray exit velocity in terms of sheet GSM, PL and CPL. In such processes, experimental data is analyzed to develop an equation for stack quality factor (SQF) in terms of purge tray exit velocity, PL, CPL, and GSM. A computer-aided optimizer or similar technique can then be used to vary purge tray exit velocity (controllable input variable) to optimize SQF (output) for various combinations of PL, CPL, and GSM (uncontrollable input variables or "noise"). The result is a series of data points each containing a unique combination of PL, CPL, and GSM and a corresponding optimized velocity. Using these data points, a regression can then be performed to develop an algorithm for output velocity in terms of sheet GSM, CPL, and PL.

In one example for a particular destination tray geometry, the velocity equation can be stated as follows:

TTExitVelocity (tics/step)=1/{[1456.8565−(6.1261*GSM)+(0.0109899*PL)−(0.4048768*CPL)+(0.002399041*GSM*PL)+(0.006976857*GSM*CPL)+(0.003006497*PL*CPL)−(0.00000960136*GSM*PL*CPL)+(0.007760081*GSM*GSM)−(0.0005599631*PL*PL)−(0.002531981*CPL*CPL)]* SP_OT2_mm/s_To_steps/tic}

Where: PL=actual sheet process length (mm),
CPL=actual sheet cross process length (mm)
GSM=actual sheet weight (gsm).

While this is one exemplary velocity equation, those ordinarily skilled in the art would understand that each different printing device will utilize a different velocity equation, depending upon the specific physical shape of the output tray, the manner in which sheets exit the printing device, the various baffles that may be included within the output tray, etc. Additionally, output trays having different designs may have different significant input factors for their velocity equation (such as sheet grain direction, coating, etc in addition to PL, CPL, and GSM). Therefore, the velocity equation is different for printers having different designs (especially as the printer design relates to the way sheets exit and the physical characteristics of the output trays) and the empirical testing performed in item 102 is performed to find these different velocity equations. Different velocity equations can even be used for different stacker trays that might be utilized on a single printing device (if the physical characteristics of the different stacker trays are sufficiently pronounced). Once the velocity equation or equations are established for a given printer design or class, they can be used for all printers of that design, and items 100 and 102 are therefore usually performed during the design process and initial testing of each new printing design, and does not need to be performed for each and every separate printing device.

Figure 2:
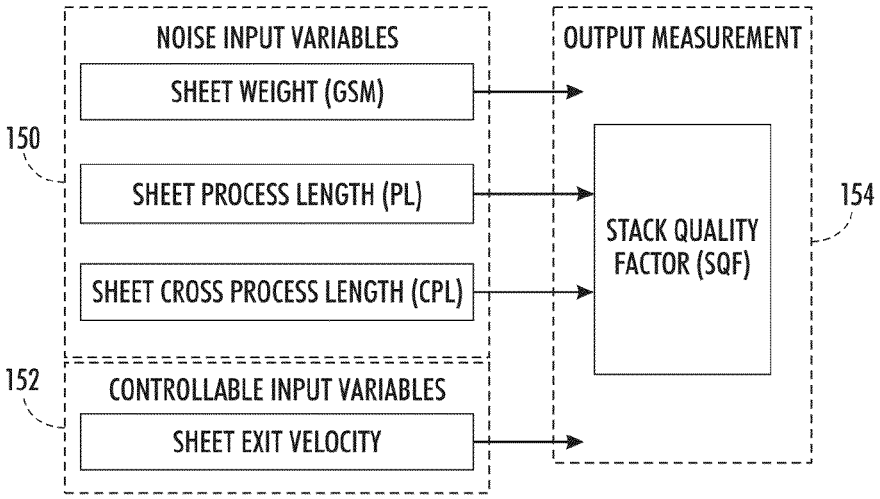
FIG. 2 is a block diagram illustrating various aspects of embodiments herein.
Figure 3:
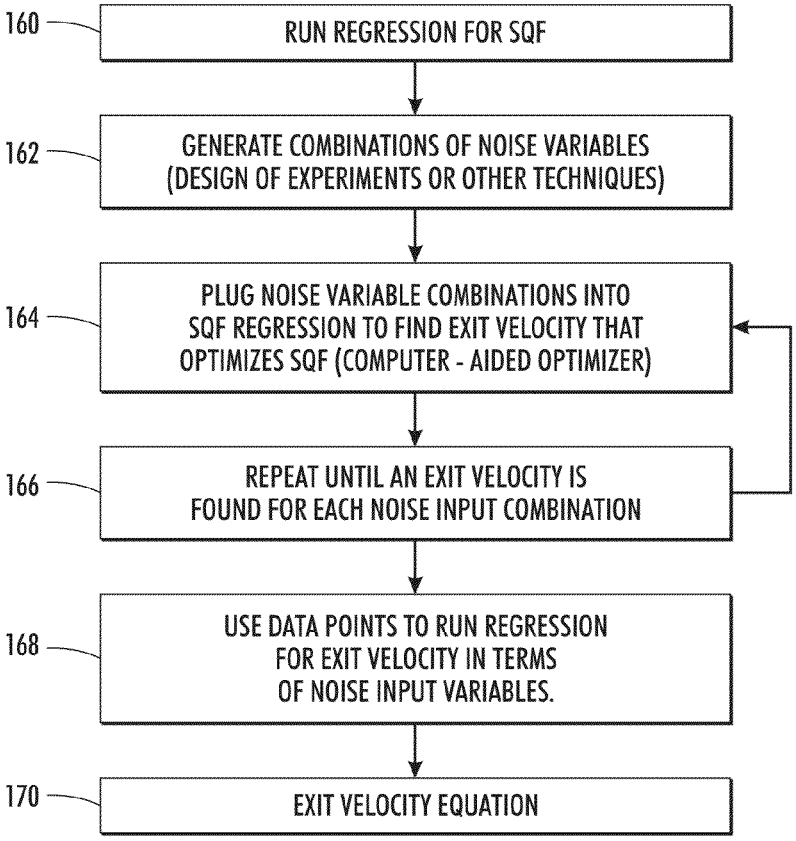
FIG. 3 is a flow diagram illustrating various methods according to embodiments herein.
Figure 4:
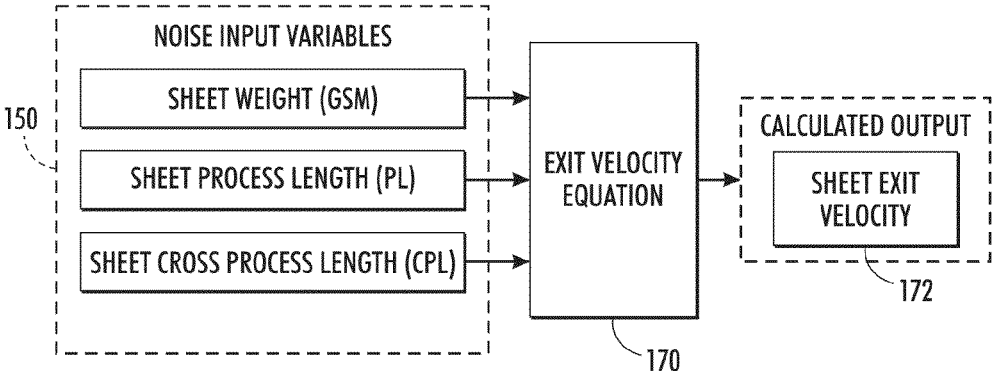
FIG. 4 is a block diagram illustrating various aspects of embodiments herein.

FIGS. 2-4 schematically illustrate the overall calculation of the sheet exit velocity according to embodiments herein. More specifically, beginning in FIG. 2, reference numeral 150 identifies noise input variables, including sheet weight (GSM) sheet process length (PL) and sheet cross process length (CPL). Item 152 identifies the controllable input variables, which in this situation is the sheet exit velocity. Item 154 identifies the output measurement, which in this situation is the stack quality factor. Many different experimental runs with different noise input variables 150 and different sheet exit velocities 152 are performed and the sheet quality factor 154 for each different experimental run is recorded. This provides the maximum sheet exit velocity that will maintain a given stack quality factor for many different sized sheets.

A simple chart of sheet size and maximum velocity could be created from the experimental data found in the processing shown in FIG. 2. However, in order to provide finer granularity, and thus to be able to make minute exit velocity adjustments based on any slight variation in the physical dimensions/properties of the sheets, in FIG. 3, the embodiments herein calculate the exit velocity equation (item 170 in FIG. 4).

More specifically in FIG. 3, as indicated by reference numeral 160, this process runs a regression analysis for the stack quality factor data obtained as shown in FIG. 2. In item 162, this process generates combinations of noise variables (using design of experiments or other techniques). Such noise variable combinations are plugged into the stack quality factor regression to find exit velocities that optimizes the stack quality factor (computer-aided optimizer) for the different sheets, in item 164. This process is repeated until an exit velocity is found for each noise input combination, as shown by reference numeral 166. In item 168, this processing uses such data points to run a regression analysis for exit velocity in terms of the noise input variables to produce the exit velocity equation 170.

As shown in FIG. 4, the same noise input variables 150 are obtained. However, in FIG. 4, the noise input variables 150 are not experimental, but are in service use values (post-production use by the consumer). The exit velocity equation 170 is applied to the noise input variables 150 in order to calculate the sheet exit velocity 172.

The overall processing is shown in flowchart form in FIG. 5. More specifically, in item 100, an exemplary method performs a timing analysis to establish acceptable sheet exit velocities, as discussed above. In item 102, this exemplary method performs empirical testing, regression analysis, and optimization to correlate different combinations of different process lengths, different cross-process widths, and different weights to a corresponding acceptable sheet exit velocity that conforms to the predetermined stack quality factor to establish the velocity equation 104 (that is sometimes referred to herein as the "predetermined velocity equation"). The predetermined velocity equation outputs different sheet exit velocities for different process lengths, different cross-process widths, and different weights of different sheets of media such that stack quality is optimized.

In order to allow the maximum number of sheets to be output during any given time period, the corresponding acceptable sheet exit velocity output by the predetermined velocity equalization is generally set at the highest sheet exit velocity that still conforms to the predetermined stack quality factor for a given combination of process length, cross-process width, and weight. This processing maintains the predetermined velocity equation within a non-volatile storage medium of the printing device (the non-volatile storage medium is readable by a processor of the printing device) in item 106.

Even though exit velocity is changed based on sheet parameters, the methods and systems herein do not impact overall output productivity. The methods and systems herein speed up or slow down exit velocity to optimize within an allowable range of velocities (item 100 in drawing) that still maintain rated PPM (prints per minute). Therefore, any velocity within this allowable range will not impact productivity. This is achieved by taking advantage of the gap that exists between sheets. For example, if sheets are slowed to a lower exit velocity, the gap between sheets at the purge tray exit shrinks; however, the required PPM is still consistently maintained.

In item 108, this exemplary method determines the process length, the cross-process width, and the weight (and/or other media properties) of a sheet of media exiting the printing device (using at least one sensor or at least one input of the printing device). For example, in item 108, sensors can potentially sense the process length, cross-process width, and/or weight of the sheet of media exiting the printing device. In item 108 the user can also input the length, width, and weight of the media through at least one user interface (that is operatively connected to the processor) when they are loading reams of unprinted media into the printer. Further, the length, width, and weight of the media can be automatically determined in item 108 using sensors of the printing device by scanning barcodes printed on the outside of the reams of unprinted media (or such information can be sensed through wireless detection (RFID communications, etc.) sensors of the printing device) as the reams of paper are loaded into the printing device. Additionally, the embodiments herein can use any combination of sensors to verify the correctness of the information input by the user regarding the length, width, and weight of the printing media in item 108.

The calculation using the predetermined velocity equation in item 108 can be performed in real time. Alternatively, a cross-reference chart can be created by supplying many different lengths, widths, and weights to the predetermined velocity equation. This cross-reference chart can be referenced in item 108 instead of performing the calculation and real-time, and a cross-reference chart can be preferable for applications that have reduced amounts of computational power. However, the advantage of performing the velocity calculation in real-time is that a greater level of accuracy can be obtained, because more specific length, width, and weight measures can be obtained from the sensors (while the cross-reference chart would include larger steps between each of the length, width, and weight values).

Item 110 checks to see if the sheet length, width, or weight found in item 108 is different from the immediately preceding sheet, or if the sheet is a new sheet (the first sheet processed in a given cycle or operating period). If the current sheet about to exit the printing device is the same length, width, and weight of the immediately preceding sheet, processing returns to item 108 to continually check each successive sheet without altering the velocity of the sheet exiting the printing device.

However, if item 110 determines that the process length, the cross-process width, or the weight of the sheet of media (that is currently in the process of exiting the printing device) is different from the immediately previous sheet (or if the immediately previous sheet does not exist because this is the first sheet being processed) the various embodiments herein perform a sheet output operation change process as shown in items 112-116. More specifically, the sheet output operation change process 112-116 can be performed, for example, after the process length and cross-process width are determined or sensed by sensors, but before the sheet of media actually exits the printing device.

The sheet output operation change process applies the media properties to the predetermined velocity equation as shown in item 112 to calculate a corresponding sheet exit velocity for the sheet of media (using the processor) as shown in item 114. Then, the sheet output operation change process controls sheet movement elements within the media path of the printing device (using the processor) to cause the sheet of media to exit the printing device at the sheet exit velocity, as shown in item 116. The sheet movement elements within the media path can comprise one or more roller nips (formed between opposing nips, at least one of which is driven), belts, vacuum devices, paper guides, and the sensor can comprise one or more edge sensors positioned, for example, within one sheet length of the roller nip. After this, processing returns to item 108 to continually check each successive sheet.

Referring to the FIG. 2 a printing machine 10 is shown that includes an automatic document feeder 20 (ADF) that can be used to scan (at a scanning station 22) original documents 11 fed from a tray 19 to a tray 23. The user may enter the desired printing and finishing instructions through the graphic user interface (GUI) or control panel 17, or use a job ticket, an electronic print job description from a remote source, etc. The control panel 17 can include one or more processors 60, power supplies, as well as storage devices 62 storing programs of instructions that are readable by the processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The belt photoreceptor 18 here is mounted on a set of rollers 26. At least one of the rollers is driven to move the photoreceptor in the direction indicated by arrow 21 past the various other known electrostatic processing stations including a charging station 28, imaging station 24 (for a raster scan laser system 25), developing station 30, and transfer station 32.

Thus, the latent image is developed with developing material to form a toner image corresponding to the latent image. More specifically, a sheet 15 is fed from a selected paper tray supply 33 to a sheet transport 34 for travel to the transfer station 32. There, the toned image is electrostatically transferred to a final print media material 15, to which it may be permanently fixed by a fusing device 16. The sheet is stripped from the photoreceptor 18 and conveyed to a fusing station 36 having fusing device 16 where the toner image is fused to the sheet. A guide can be applied to the substrate 15 to lead it away from the fuser roll. After separating from the fuser roll, the substrate 15 is then transported by a sheet output transport 37 to output trays a multi-function finishing station 50.

Printed sheets 15 from the printer 10 can be accepted at an entry port 38 and directed to multiple paths and output trays 54, 55 for printed sheets, corresponding to different desired actions, such as stapling, hole-punching and C or Z-folding. The finisher 50 can also optionally include, for example, a modular booklet maker 40 although those ordinarily skilled in the art would understand that the finisher 50 could comprise any functional unit, and that the modular booklet maker 40 is merely shown as one example. The finished booklets are collected in a stacker 70. It is to be understood that various rollers and other devices that contact and handle sheets within finisher module 50 are driven by various motors, solenoids and other electromechanical devices (not shown), under a control system, such as including the microprocessor 60 of the control panel 17 or elsewhere, in a manner generally familiar in the art.

Thus, the multi-functional finisher 50 has a top tray 54 and a main tray 55 and a folding and booklet making section 40 that adds stapled and unstapled booklet making, and single sheet C-fold and Z-fold capabilities. The top tray 54 is used as a purge destination, as well as, a destination for the simplest of jobs that require no finishing and no collated stacking. The main tray 55 can have, for example, a pair of pass-through sheet upside down staplers 56 and is used for most jobs that require stacking or stapling As would be understood by those ordinarily skilled in the art, the printing device 10 shown in FIG. 2 is only one example and the embodiments herein are equally applicable to other types of printing devices that may include fewer components or more components. For example, while a limited number of printing engines and paper paths are illustrated in FIG. 2 those ordinarily skilled in the art would understand that many more paper paths and additional printing engines could be included within any printing device used with embodiments herein.

In such a computerized (printing) device 10, the non-volatile storage medium 62 in the control panel 17 maintains the predetermined velocity equation that outputs different sheet exit velocities for different process lengths, different cross-process widths, and different weight of different sheets of media (discussed above).

Further, the printing device embodiments herein can also include one or more sensors 64 operatively connected to the processor 60. The sensors 64 can potentially sense the process length, cross-process width, and weight of the sheet of media exiting the printing device. The sensors 64 can comprise, for example, one or more leading edge sensors, trailing edge sensors, side edge sensors 64, sheet thickness sensors, scale (weight) sensors, etc. Further, these sensors 64 can be positioned at any location within the printing device and, in one example, can be positioned immediately adjacent the exit roller nip 66 that controls the printer exit velocity of the sheet of media. For purposes herein, immediately adjacent can mean, for example, within one sheet length (in the process length direction) of the exit roller nip. Additionally, while the sensors 64 and exit roller nip 66 are shown as being located within the finisher 50, those ordinarily skilled in the art would understand that if a finisher 50 were not utilized, such sensors 64 and exit roller nip 66 would be located within the body of the printing device 10.

The user can also input the length, width, and weight of the media through at least one user interface 17 (that is operatively connected to the processor 60) when they are loading reams of unprinted media into the printer. Further, the length, width, and weight of the media can be automatically determined using sensors of the printing device by scanning barcodes printed on the outside of the reams of unprinted media (or such information can be sensed through wireless detection (RFID communications, etc.) sensors 64 of the printing device) as the reams of paper are loaded into the printing device 10. Additionally, the embodiments herein can use any combination of sensors 64 to verify the correctness of the information input by the user regarding the length, width, and weight of the printing media.

A media path is also operatively connected to the processor 60. The media path comprises sheet movement elements that move the sheets of media from the input 33 to the exit 54, 55, 70 of the printing device. For example, the sheet movement elements within the media path comprising roller nips (formed between opposing driven nips), belts, vacuum devices, paper guides, etc.

The processor 60 applies the media properties to the predetermined velocity equation to calculate a corresponding sheet exit velocity for the sheet of media. Further, the processor 60 controls the sheet movement elements within the media path of the printing device to cause the sheet of media to exit the printing device at the calculated sheet exit velocity. Printers normally operate at their maximum operating speed and, therefore, the usual adjustment that will be made by the predetermined velocity equation is to reduce the velocity; however, such is not always the case and, if a previous sheet required a lower velocity, the predetermined velocity equation may increase the velocity of subsequent sheets.

Therefore, as shown above, the methods and devices herein reduce or eliminate stacking problems within the output tray of printing devices without requiring any additional, baffles, etc., and at very little increase cost to the user. This increases user satisfaction, reduces service calls, reduces waste, and generally makes the printing device more valuable.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Pat. No. 6,032,004, the complete disclosure of which is fully incorporated herein by reference. The embodiments herein can encompass embodiments that print in color, monochrome, or handle color or monochrome image data. All foregoing embodiments are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein cannot be implied or imported from any above example as limitations to any particular order, number, position, size, shape, angle, color, or material.

What is claimed is:

1. A method comprising:

maintaining a predetermined velocity equation within a non-volatile storage medium of a printing device, said non-volatile storage medium being readable by a processor of said printing device, and said predetermined velocity equation outputting different sheet exit velocities for different media properties of different sheets of media;

determining media properties of a sheet of media exiting said printing device;

applying said media properties of said sheet of media to said predetermined velocity equation to calculate a corresponding sheet exit velocity for said sheet of media, using said processor; and controlling sheet movement elements within a media path of said printing device using said processor to cause said sheet of media to exit said printing device at said sheet exit velocity.

2. The method according to claim 1, further comprising empirically testing sheets having different process lengths, different cross-process widths, and different weights at said different sheet exit velocities to establish acceptable sheet exit velocities that cause said sheets to conform to a predetermined stack quality factor.

3. The method according to claim 2, further comprising establishing said predetermined velocity equation by correlating different combinations of different process lengths, different cross-process widths, and different weights to a corresponding acceptable sheet exit velocity that conforms to said predetermined stack quality factor.

4. The method according to claim 3, said corresponding acceptable sheet exit velocity for a given combination of process length, cross-process width, and weight comprising the highest sheet exit velocity that conforms to said predetermined stack quality factor for said given combination of process length, cross-process width, and weight.

5. The method according to claim 1, said sheet movement elements within said media path comprising at least one roller nip.

6. A method comprising:

maintaining a predetermined velocity equation within a non-volatile storage medium of a printing device, said non-volatile storage medium being readable by a processor of said printing device, and said predetermined velocity equation outputting different sheet exit velocities for different process lengths, different cross-process widths, and different weights of different sheets of media;

determining a process length, a cross-process width, and a weight of a sheet of media exiting said printing device using at least one sensor or at least one input of said printing device;

if any of said process length, said cross-process width, and said weight are different from an immediately previous sheet, performing a sheet output operation change process; and if said immediately previous sheet does not exist, performing said sheet output operation change process, said sheet output operation change process being performed after said sensing and before said sheet of media exits said printing device, and said sheet output operation change process comprising:

applying said process length, said cross-process width, and said weight to said predetermined velocity equation to calculate a corresponding sheet exit velocity for said sheet of media, using said processor; and controlling sheet movement elements within a media path of said printing device using said processor to cause said sheet of media to exit said printing device at said sheet exit velocity.

7. The method according to claim 6, further comprising empirically testing sheets having said different process lengths, said different cross-process widths, and said different weights at said different sheet exit velocities to establish acceptable sheet exit velocities that cause said sheets to conform to a predetermined stack quality factor.

8. The method according to claim 7, further comprising establishing said predetermined velocity equation by correlating different combinations of different process lengths, different cross-process widths, and different weights to a corresponding acceptable sheet exit velocity that conforms to said predetermined stack quality factor.

9. The method according to claim 8, said corresponding acceptable sheet exit velocity for a given combination of process length, cross-process width, and weight comprising the highest sheet exit velocity that conforms to said predetermined stack quality factor for said given combination of process length, cross-process width, and weight.

10. The method according to claim 6, said sheet movement elements within said media path comprising at least one roller nip, and said sensor comprising at least one edge sensor positioned within one processing direction sheet length of said roller nip.

11. A method comprising:

maintaining a predetermined velocity equation within a non-volatile storage medium of a printing device, said non-volatile storage medium being readable by a processor of said printing device, and said predetermined velocity equation outputting different sheet exit velocities for different media properties of different sheets of media that cause said sheets to conform to a predetermined stack quality factor;

determining media properties of a sheet of media exiting said printing device;

applying said media properties of said sheet of media to said predetermined velocity equation to calculate a corresponding sheet exit velocity for said sheet of media that is different from sheet exit velocities for different sheets of media to conform to said predetermined stack quality factor, using said processor; and controlling sheet movement elements within a media path of said printing device using said processor to cause said sheet of media to exit said printing device at said sheet exit velocity.

12. The method according to claim 11, further comprising empirically testing sheets having different process lengths, different cross-process widths, and different weights at said different sheet exit velocities to establish acceptable sheet exit velocities that cause said sheets to conform to said predetermined stack quality factor.

13. The method according to claim 12, further comprising establishing said predetermined velocity equation by correlating different combinations of different process lengths, different cross-process widths, and different weights to a corresponding acceptable sheet exit velocity that conforms to said predetermined stack quality factor.

14. The method according to claim 13, said corresponding acceptable sheet exit velocity for a given combination of process length, cross-process width, and weight comprising the highest sheet exit velocity that conforms to said predetermined stack quality factor for said given combination of process length, cross-process width, and weight.

15. The method according to claim 11, said sheet movement elements within said media path comprising at least one roller nip.

16. A method comprising:

maintaining a predetermined velocity equation within a non-volatile storage medium of a printing device, said non-volatile storage medium being readable by a processor of said printing device, and said predetermined velocity equation outputting different sheet exit velocities for different process lengths, different cross-process widths, and different weights of different sheets of media that cause said sheets to conform to a predetermined stack quality factor;

determining a process length, a cross-process width, and a weight of a sheet of media exiting said printing device using at least one sensor or at least one input of said printing device;

if any of said process length, said cross-process width, and said weight are different from an immediately previous sheet, performing a sheet output operation change process; and if said immediately previous sheet does not exist, performing said sheet output operation change process, said sheet output operation change process being performed after said sensing and before said sheet of media exits said printing device, and said sheet output operation change process comprising:

applying said process length, said cross-process width, and said weight to said predetermined velocity equation to calculate a corresponding sheet exit velocity for said sheet of media, using said processor; and controlling sheet movement elements within a media path of said printing device using said processor to cause said sheet of media to exit said printing device at said sheet exit velocity.

17. The method according to claim 16, further comprising empirically testing sheets having said different process lengths, said different cross-process widths, and said different weights at said different sheet exit velocities to establish acceptable sheet exit velocities that cause said sheets to conform to said predetermined stack quality factor.

18. The method according to claim 17, further comprising establishing said predetermined velocity equation by correlating different combinations of different process lengths, different cross-process widths, and different weights to a corresponding acceptable sheet exit velocity that conforms to said predetermined stack quality factor.

19. The method according to claim 18, said corresponding acceptable sheet exit velocity for a given combination of process length, cross-process width, and weight comprising the highest sheet exit velocity that conforms to said predetermined stack quality factor for said given combination of process length, cross-process width, and weight.

20. The method according to claim 16, said sheet movement elements within said media path comprising at least one roller nip, and said sensor comprising at least one edge sensor positioned within one processing direction sheet length of said roller nip.

* * * * *